US005409043A

United States Patent [19]

Zenoni et al.

[11] Patent Number: 5,409,043

[45] Date of Patent: * Apr. 25, 1995

[54] ANNULAR THREAD BRAKING BAND FOR WEFT FEEDER

[76] Inventors: Pietro Zenoni, Via Montegrappa, 3; Giovanni Pedrini, Via Mosconi, 29, both of 24026 Leffe (Prov. di Bergamo); Rosario Castelli, Via San Rocco, 15, 24024 Gandino (Prov. di Bergamo), all of Italy

[ * ] Notice: The portion of the term of this patent subsequent to May 31, 2011 has been disclaimed.

[21] Appl. No.: 203,068

[22] Filed: Feb. 28, 1994

Related U.S. Application Data

[62] Division of Ser. No. 944,382, Sep. 14, 1992, Pat. No. 5,316,051.

[30] Foreign Application Priority Data

Sep. 20, 1991 [IT] Italy ..... TO91A0713
Apr. 30, 1992 [IT] Italy ..... TO92A0372

[51] Int. Cl.[6] ..... D03D 47/36

[52] U.S. Cl. ..... 139/452; 242/47.01; 242/147 R

[58] Field of Search ..... 242/150 R, 147 R, 47.01; 139/452

[56] References Cited

U.S. PATENT DOCUMENTS 781,861 2/1905 Allen ..... 242/150
1,815,532 7/1931 Vesey .
2,425,525 8/1947 Franz .
3,112,899 12/1963 Hosbein .
3,498,564 3/1970 Dismon .
3,834,635 9/1974 Pfarrwaller .
3,940,079 2/1976 Vella .
3,995,786 12/1976 Deniega ..... 139/452 X
4,068,807 1/1978 Jacobsson ..... 139/452 X
4,121,782 12/1978 Shelton .
4,161,297 7/1979 Vella ..... 139/452 X
4,429,723 2/1984 Maroino ..... 139/452
4,901,943 2/1990 Candino ..... 242/150 R
4,926,912 5/1990 Zenoni ..... 139/452
5,046,536 9/1991 Zenoni ..... 139/452
5,316,051 5/1994 Zenoni et al. ..... 139/452

FOREIGN PATENT DOCUMENTS 1760658 2/1972 Germany .

*Primary Examiner*—Andrew M. Falik
*Attorney, Agent, or Firm*—Modiano & Associati

[57] ABSTRACT

A braking device and a system for braking thread being drawn off of a thread storage drum over its output circumference. The braking device includes a braking body having a band which is symmetric in shape around an axis and has a continuous active braking surface facing inwardly toward the axis, the surface being sufficiently hard to be resistant to wear from thread friction. An elastic member urges the band, and thus the braking surface, into engagement with an output circumference on the drum so as to brake thread passing through the braking body between the surface and the drum output curcumference.

21 Claims, 4 Drawing Sheets

ANNULAR THREAD BRAKING BAND FOR WEFT FEEDER

RELATED APPLICATION

This application is a division of application Ser. No. 07/944,382, filed Sep. 14, 1992 , now U.S. Pat. No. 5,316,051.

BACKGROUND OF THE INVENTION

The present invention relates to a self-adjusting thread braking device for units for feeding the weft to textile machines, in particular shuttle-less, gripper and bullet looms.

As is known, weft feeders are units which comprise a fixed cylindrical drum on which a rotating arm winds a plurality of turns of thread which constitute a feed reserve, means for causing the advancement of the reserve turns from the base to the end of the drum and means for braking in output the thread which unwinds from the drum and feeds the loom.

The evolution of shuttle-less looms, as a consequence of which significant increases in the amounts (meters) of weft thread inserted in the unit time (minute) have been achieved, entails considerable thread braking problems for the solution of which known braking means have proved to be fully inadequate.

Two kinds of braking means, both mechanical, have substantially been used so far: brush brakes and those with metallic laminas. Brush brakes of the first kind are constituted by an annular set of bristles, typically made of synthetic fibers, which is arranged inside a ring which surrounds the fixed drum. The bristles are in contact with the drum and brake the thread which unwinds from it with their elastic action. This type of brake, which is very effective in terms of balloon reduction, performs a modest braking action which is matched by modest thread tension but, most of all, said action is discontinuous and rapidly degrades due to the wear of the bristles and/or to their clogging caused by dust and lint. It is therefore generally used in combination with a disk brake or with a brake with opposite metallic laminas which however, besides also being subject to clogging, introduces evident structural complications and other problems specified hereinafter.

Brakes of the second type, which comprise a plurality of individual laminas which elastically engage the drum of the unit, are partially free from these problems and essentially perform a stronger braking action, but at the price of considerable structural complication of the braking element and of discontinuity in the braking action due to the transfer of the thread from one lamina to the next.

Furthermore, the cyclic passage of the thread beneath the individual laminas fatigue-stresses said laminas; the stress is greater as the count of the thread increases, and this causes the breakage of the laminas in a relatively short time.

But the greatest problem, which is common to both of the above known brake types, is constituted by the fact that the braking action exerted on the thread depends on the advancement speed of said thread and increases in an approximately linear manner together with said speed due to the fact that, in these systems, the friction coefficient $\mu$ between the braking means and the thread varies correspondingly according to the speed. Typically, the diagram of the speeds of the grippers of a modern loom is approximately sinusoidal with two half-periods per beat cycle. Consequently, speed passes from a null value during the swapping of the weft between the clamps to a maximum value during weft traction.

For correct weaving, the thread must be subjected to tension during the entire beating cycle. In particular, the thread must be subjected to an adequate tension, hereinafter termed static tension, even when the speed of the grippers becomes zero. Static tension is set by acting on the elements for adjusting the braking means; said elements vary the contact pressure between the braking means and the thread. Said pressure cannot drop below a certain value, to prevent failure to transfer the weft between the grippers and/or the presence of loose wefts on the side of the piece of fabric at which the pulling gripper releases said weft. As the speed increases, said static tension, set to the minimum value which is compatible with these requirements, reaches values which are much higher in percentage, and in modern looms increases of 700% in static tension can easily be reached, with the consequent easy and frequent breakage of the weft thread.

In order to try to obviate this severe problem, it has been proposed to modulate the braking action of the braking means by varying the contact pressure of said braking means by virtue of an electromagnetic device which is supplied with an electric current which varies according to the speed of the loom. The prior international patent application published as no. WO 91/14032 illustrates a device of this type whose use, however, is very onerous, since it requires a current supply means which can consistently follow the speed variations of the loom. Furthermore, said known electromagnetic device on one hand significantly complicates the structure of the weft feed unit and on the other hand, due to the inertia of the braking system, is not fully satisfactory in terms of the adjustment of the braking action which said system applies to the thread.

SUMMARY OF THE INVENTION

The aim of the present invention is to eliminate the severe problems of known thread braking devices.

Within the above aim, a particular important object of said invention is to provide a braking device which is self-adjusting, i.e. capable of automatically adapting the braking action applied to the thread to the advancement speed of said thread so as to significantly reduce the tension changes to which said thread is subjected.

This aim and object are achieved by a self-adjusting thread braking device as defined in the appended claims.

The present invention is based on the concept of exploiting the thread's tension changes themselves in order to correspondingly vary the contact pressure between the braking means and said thread. This is obtained, according to the invention, by providing the braking device with a single braking body which is substantially shaped like a truncated cone, is arranged in front of the fixed drum of the weft feed unit and is actuated so that it adheres elastically to said fixed drum, to which it is tangent at an output circumference which is slightly smaller than the maximum one. The braking body is supported by elastic suspension means, typically by an annular elastic lamina which is in turn accommodated in a ring rigidly coupled to a support which is axially movable with respect to the drum in order to adjust the static contact pressure between said rigid body and said drum. The thread runs between the drum and the braking body, whereon the axial component thread tension is discharged, and said component is constantly balanced by the elastic suspension means. In this manner, when the tension on the thread increases, as the advancement speed of said thread increases, said axial component tension moves the braking body against the action of the elastic suspension means and causes, or tends to cause, separation of the body from the drum with a consequent and corresponding decrease in the braking action. The braking body advantageously has, at least on its active surface which makes contact with the thread, a high resistance to wear, very small inertia, marked radial elasticity and substantial axial rigidity. For this purpose, it is preferably constituted by a fabric, or by a laminate of high-strength synthetic fibers, typically carbon fibers or fibers of the material known by the trade-name "Kevlar".

Steel plate with a thickness comprised between four and ten hundredths of a millimeter is also suitable for the manufacture of the braking body, and it is possible to adopt a mixed structure which comprises a body made of synthetic material which is covered, on the active surface, by a thin wear-resistant metallic layer.

BRIEF DESCRIPTION OF THE DRAWINGS

The invention will become apparent from the following detailed description and with reference to the accompanying drawings, provided by way of non-limitative example, wherein.

DESCRIPTION OF THE PREFERRED EMBODIMENTS

Figure 1:
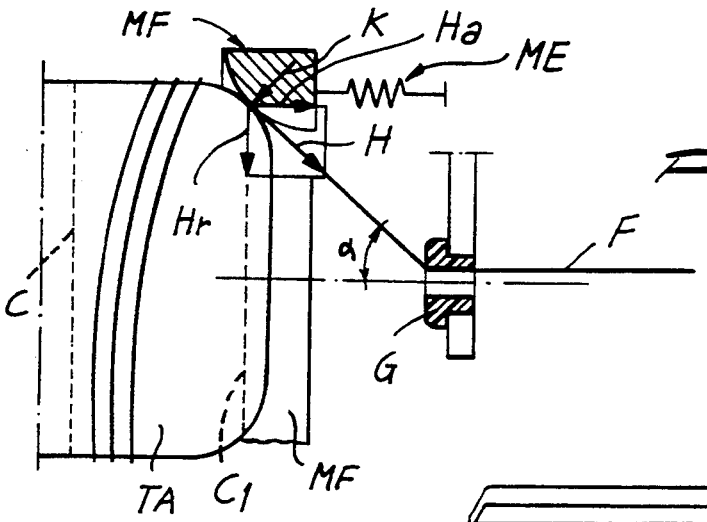
FIG. 1 is a schematic view of the operating principle of the self-adjusting braking device according to the present invention.

With reference to FIG. 1, TA designates the fixed drum of a weft feed unit 10 of a known type which is better described hereinafter, and MF designates a single braking means for the thread F which unwinds from the drum TA, passing through a thread guide G which is coaxial to the drum. The braking means MF, which has a continuous circular extension, is actuated With an elastic force $\overline{K}$ into contact engagement with the drum TA by an elastic means ME and consequently elastically engages the thread F, pushing it against the drum.

Contact between the braking means MF and the drum TA occurs along an output circumference C1 of the drum which is smaller than the maximum circumference C, so that the thread F extends from the points of contact located on the circumference C1 to the thread guide G along a straight path which is inclined by an angle "$\alpha$" with respect to the axis "a" of the drum. The braking unit MF generates on the thread a tension $\overline{H}=\mu\overline{K}$, where $\mu$ is the friction coefficient between the drum and the thread and, due to the inclined path followed by said thread, said tension has a radial component $\overline{Hr}$ and an axial one Ha. The latter is discharged onto the braking means and is constantly balanced by the elastic means ME. When the tension $\overline{H}$ rises as the speed of the thread changes, the component Ha increases correspondingly and causes the movement of, or tends to move, the braking means MF away from the drum, with the consequence that the tension $\overline{H}$ on the thread decreases.

Figure 2:
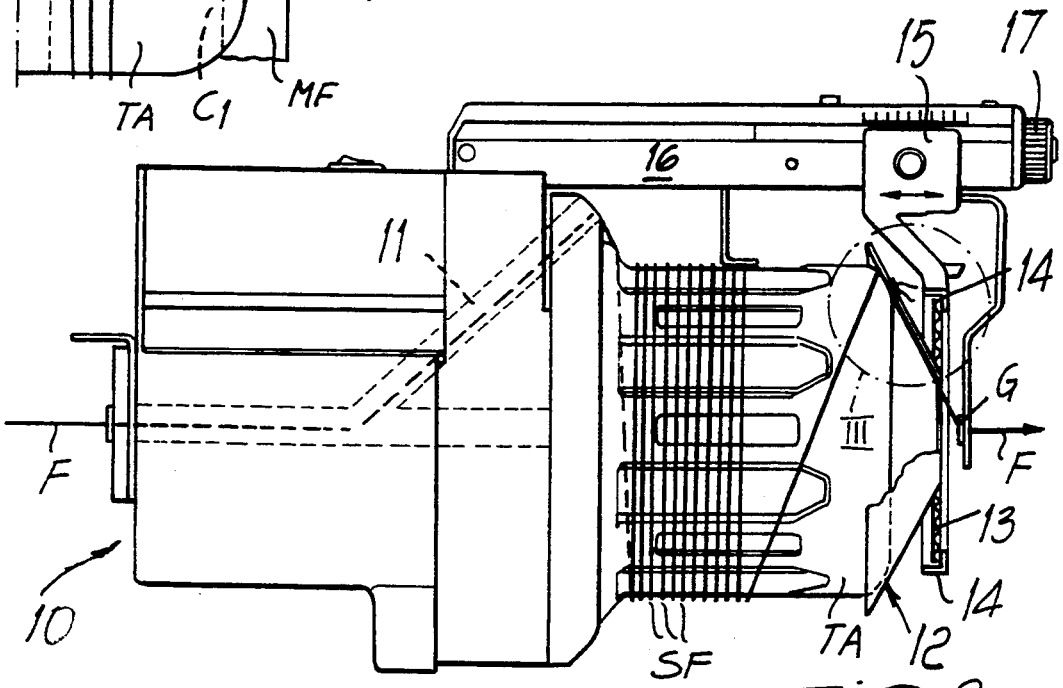
FIG. 2 is a lateral elevation view of a weft feed unit with the self-adjusting device according to an embodiment of the invention.

FIG. 2 illustrates a weft feed unit 10 which has a fixed drum TA on which a rotating arm 11 winds a plurality of turns of thread SF which constitute a thread reserve and is provided with a single braking means ME constituted by a braking body 12 which is substantially shaped like a truncated cone. The generatrices of the body 12 are preferably straight, but this is non-limitative, and it is equally possible to use bodies 12 having curved, for example parabolic, generatrices. Regardless, the body 12 is axisymmetric in shape.

Figure 3:
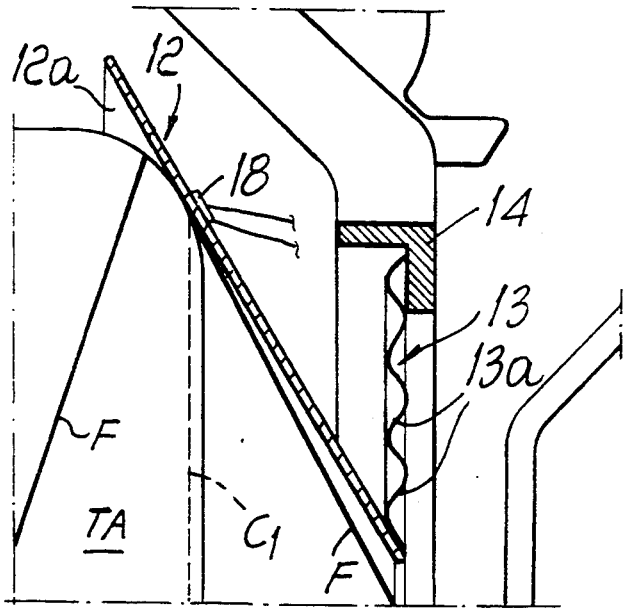
FIG. 3 is an enlarged-scale view of a detail of FIG. 2.

An elastic means ME is provided in order to support the braking body 12 in front of the drum TA and coaxially thereto and to the thread guide G and in order to actuate said body so that it engages, by elastic contact, the drum along a circumference C1 of the drum, which is smaller than the maximum circumference thereof. The taper of the rigid body 12 is a few degrees smaller than the angle $\alpha$ which the thread F forms with the axis of the drum, so that contact between said body and the thread occurs only at the circumference C1. The elastic means ME is constituted (FIG. 3) by an annular lamina 13, made of metal or synthetic material, which surrounds the body 12 and has a surface provided with concentric ridges **13*a* which is elastically deformable along a direction parallel to the axis "a" of the drum. The lamina 13 surrounding the truncated-cone body 12, to which it is connected at the smaller diameter, is accommodated in a ring-like support 14 rigidly coupled to a truck 15 slidable on a guide 16 arranged parallel to the drum TA. A known traction device, for example of the screw-and-nut type, provided with an actuation knob 17, allows to move the truck 15 on the guide 16 and to vary the elastic force K (static force) with which the body 12 presses on the drum TA. The truncated-cone braking body 12** is manufactured such that it has marked radial elasticity, substantial axial rigidity and limited inertia. With this elastic construction, the passage of any knots present on the thread does not generate sudden and rapid increases in tension on said thread.

For this purpose, the truncated-cone body 12 is advantageously made of a high-strength synthetic material, such as a fabric impregnated with polymeric resin or a laminate of synthetic fibers, typically carbon or "Kevlar" fibers, possibly applying a very hard thin metallic layer in a band on the active surface **12*a*** of said body.

According to another embodiment, the body 12 is a band made of steel plate with a thickness comprised between 0.05 and 0.1 mm, and it is possible to harden the active surface 12*a* of a steel braking body by depositing thereon a layer of nickel or chrome.

It should be noted that the body 12 is self-cleaning, by virtue of the continuity of the surface of the body 12 and since the thread, by rotating like the pointer of a clock inside the body 12, removes lint and dust.

A piezoelectric sensor 18 is preferably applied on the body 12 and counts the number of turns which unwind from the drum and, in a known manner, provides a control microprocessor (not illustrated) with data useful for the management of the unit 10.

Figure 4:
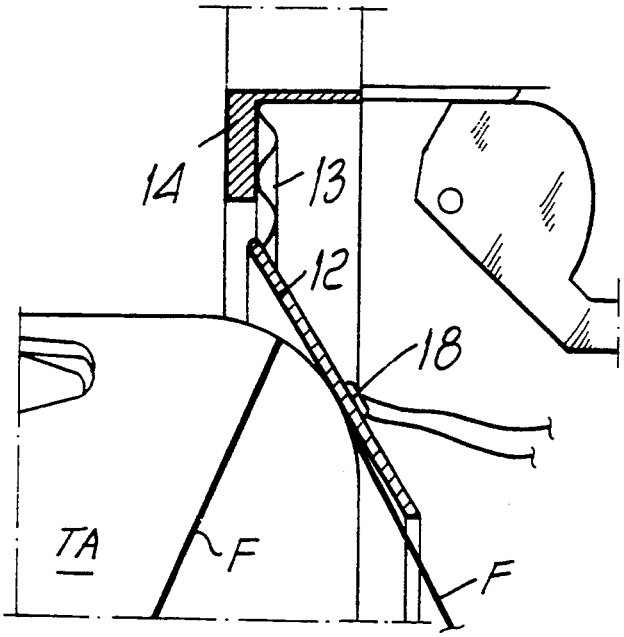
FIG. 4 is a detail view, similar to FIG. 3, of another embodiment of the invention.

In the embodiment of FIG. 4, the lamina 13 is connected to the truncated-cone body 12 at the larger diameter thereof in order to provide a more rigid braking system.

Figure 5:
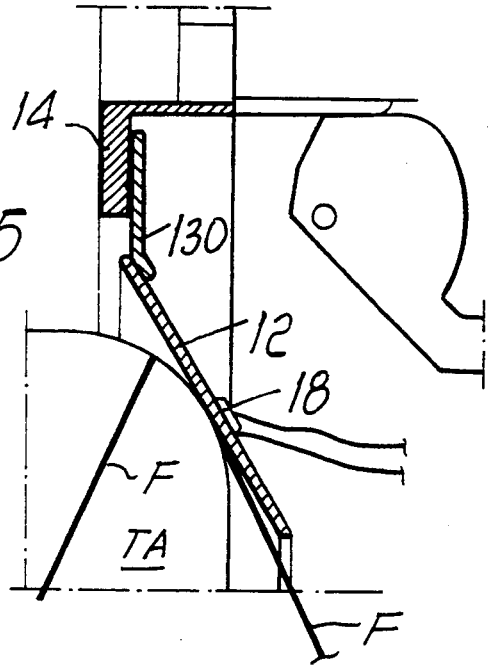
FIGS. 5 to 7 are detail views, similar to FIG. 3, of other respective embodiments of the invention.

In the embodiment of FIG. 5, the body 12 is elastically suspended by means of a flat lamina 130 instead of an undulated one, again with the purpose of increasing the rigidity of the system.

Figure 6:
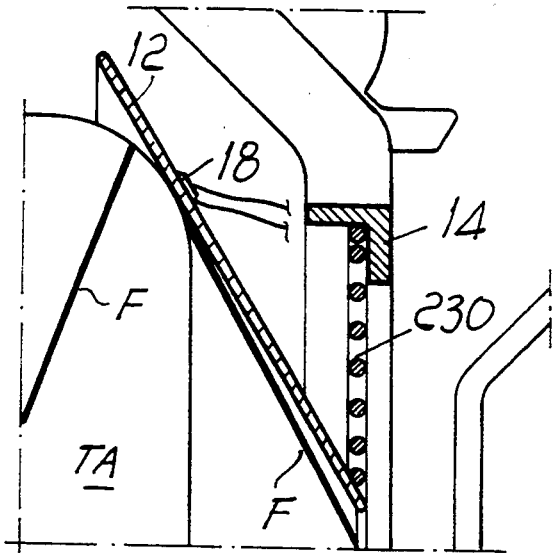
Figure 7:
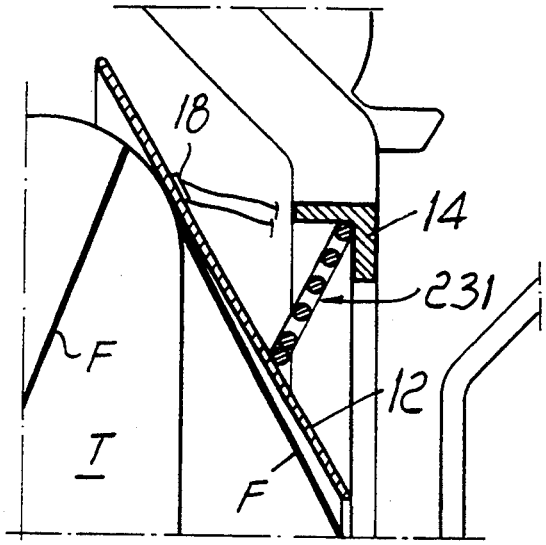

In the embodiments of FIGS. 6 and 7, elastic suspension of the body 12 is provided by means of a flat spiral spring 230 or respectively by means of a conical spring 231; the taper of the spring 231 is opposite to the one of the body 12.

Numerous tests which have been conducted have shown that with the device according to the present invention the variations in the tension $\overline{H}$ on the thread are contained within 80–100% of the static value for thread speeds comprised between 0 and 50 m/sec required by modern gripper and bullet looms.

This modest percentage variation in the tension of the thread is considered quite acceptable for most weaving processes and drastically reduces stoppages due to thread breakage.

In some cases, however, for example in the presence of threads having a very small count, if contact between the braking body 12 and the thread occurs only at the points of the output circumference C1, the self-adjusting action of the braking body can be reduced, in that the elastic yielding of the braking body is less rapid and marked due to the lower intensity of the traction T to which said low-count threads are subjected.

This problem is eliminated by tapering the truncated-cone braking body (i.e., imparting thereto an inclination of the generatrices with respect to the axis of the cone), the taper being greater than the angle $\alpha$ which the thread forms with the axis of the drum in the portion comprised between the output circumference C1 and the thread guide G.

Figure 8:
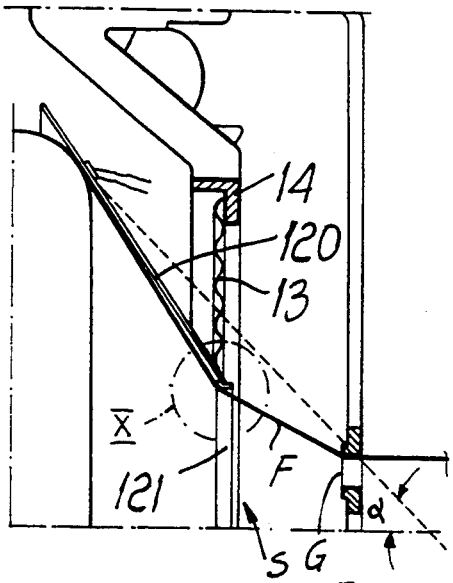
FIG. 8 is a detail view, similar to FIG. 3, illustrating another embodiment of the invention.

In the embodiment of FIG. 8, the braking body 120 has a taper which is greater than the angle $\alpha$ which the thread would form, in the absence of the body 120, with the axis "a" of the drum TA in the portion comprised between the output circumference C1 and the terminal thread guide G. The thread is therefore redirected by the terminal or smaller section S of the truncated-cone body 120 which is provided with a metallic ring 121.

Figure 9:
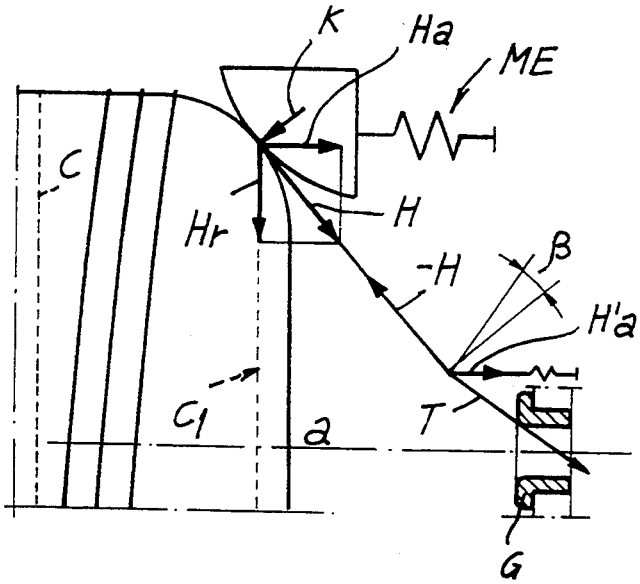
FIG. 9 is a schematic view, similar to FIG. 1, illustrating the operation of the device of FIG. 8.

Accordingly, as shown by the schematic view of FIG. 9, the thread discharges onto said ring 121 of the truncated-cone braking body 120 a second axial component $$\overline{H}'a = \overline{T}e^{f\beta} - \overline{H}$$

where T is the traction applied to the thread after the truncated-cone braking body 120, f is the friction coefficient between the thread and the ring 121 and $\beta$ is the angle of winding of the thread on said ring.

The component $\overline{H}'a$ is added to the component $\overline{H}a$ which said thread discharges onto the body 120 at the points of tangency of said body with respect to the drum TA and significantly improves the elastic response of the truncated-cone braking body to variations in the traction T.

Figure 10:
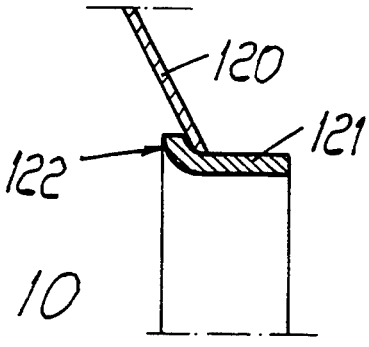
FIG. 10 is an enlarged-scale view of a detail of FIG. 8.

The ring 121 fitted on the terminal section of the truncated-cone braking body 120 is made of brass or steel plate with a thickness of 2÷3 tenths of a millimeter, and advantageously has a flared edge 122 (FIG. 10) which slightly protrudes inside the truncated-cone body 120. As clearly shown in the Figure, the flared edge 122 keeps the thread F adjacent to, but spaced from, the inner surface of the body 120, with the advantage that the thread, in its rotary unwinding motion, does not slide on said surface (and therefore is not subjected to uncontrolled braking and torsion) but at the same time performs a cleaning action with regard to the lint which tends to deposit thereon.

Figure 11:
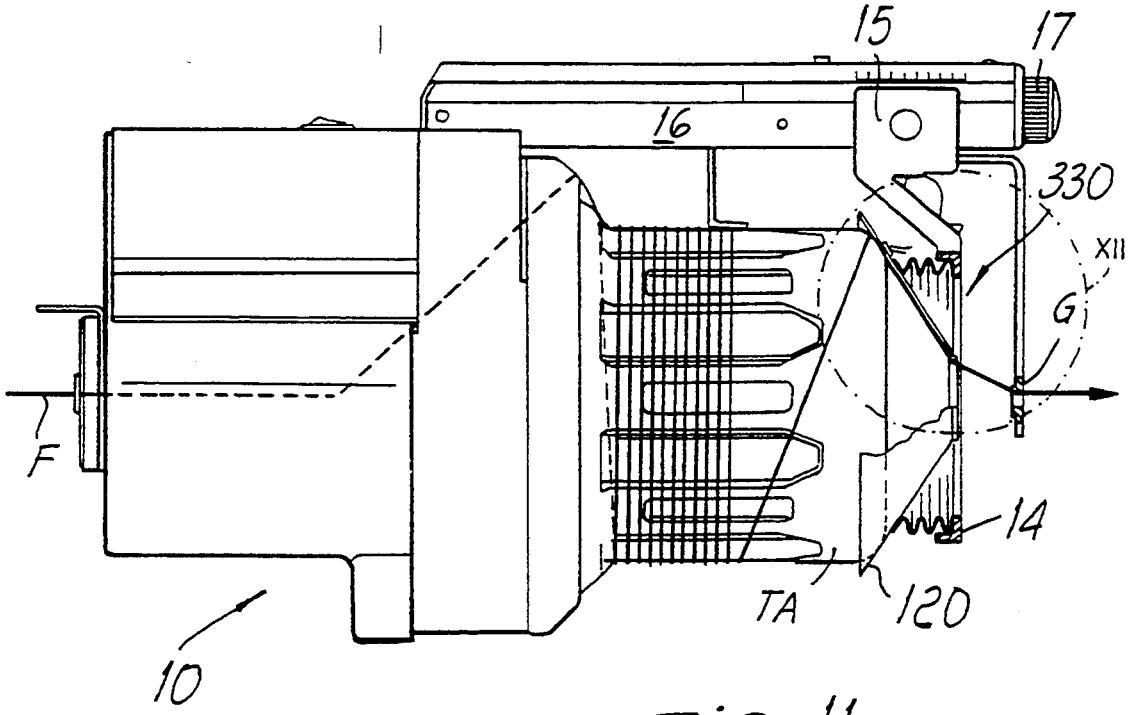
FIG. 11 is an elevation view of a weft feed unit with the self-adjusting device according to another embodiment of the invention.
Figure 12:
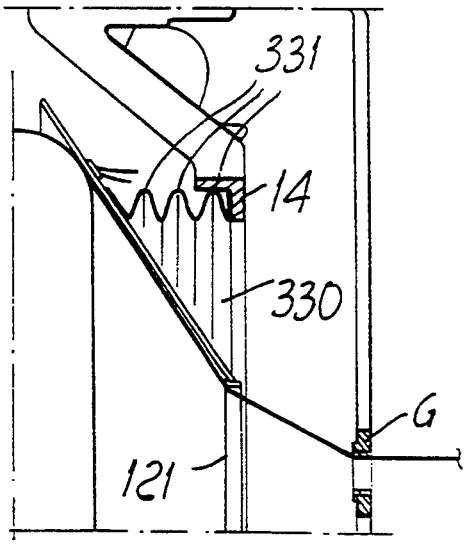
FIG. 12 is an enlarged-scale view of a detail of FIG. 11.

The variations of FIGS. 11 and 12 show an improved elastic suspension means 330 for the truncated-cone braking body 120; said suspension means, by virtue of its greater axial elasticity, further contributes to improve the modulation of the braking action of said truncated-cone braking body on threads having a small count.

The suspension means 330 is constituted by a bellows-like element which extends parallel to the axial direction of the drum TA and is formed by a plurality of parallel undulations 331 which have a substantially sinusoidal profile. The element 330 is preferably made of a non-metallic material with low resilience, advantageously woven or calendared polymeric material, cardboard treated with polymeric resins, or natural-fiber fabric also treated with polymeric resins. However, a thin metallic plate, for example made of steel, with a thickness comprised between one and three tenths of a millimeter, is suitable to provide the bellows-like element 330.

One end of the element 330 is coupled, advantageously glued, to the supporting ring 14, and the other end is coupled, advantageously glued, to the truncated-cone braking body 120. The element 330 is hollow, and its outer diameter is slightly smaller (5÷15% smaller) than the diameter of the output circumference C1 defined earlier. Accordingly, a substantial part of the truncated-cone body 120 is freely contained in the cavity of the element 330, and this improves the response of the braking system to the stress of the axial component $\overline{H}'a$.

Figure 13:
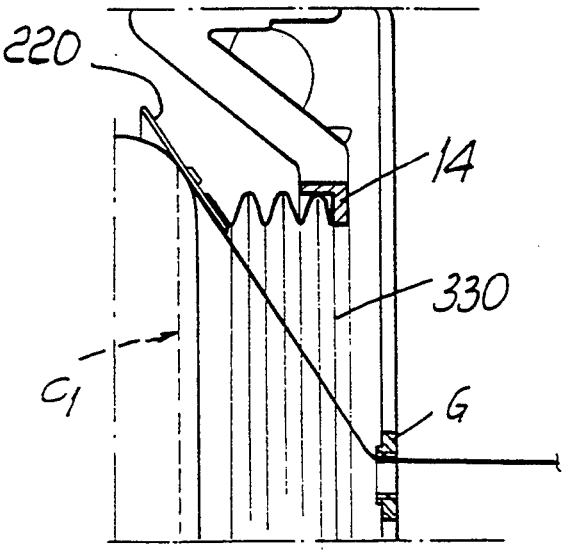
FIG. 13 is a detail view, similar to FIG. 12, of a further embodiment of the invention.

The variation of FIG. 13 relates to a different configuration of the truncated-cone braking body which is aimed at reducing its mass and thus its inertia, again with the object of improving the modulated response of the braking system when said system is used for lower-count threads.

According to this variation, in combination with a cylindrical bellows-like suspension element 330 there is a truncated-cone braking body, reduced to a truncated-cone band 220 which is supported by the free end of the bellows-like element 330 and extends, between annular edges for a limited amount comprised for example between 5 and 15 mm, on both sides of the output circumference C1 of the drum TA. This provides for said band to substantially wider than it is thicker. The truncated-cone band 220 has a taper which is slightly smaller (2÷3% smaller) than the angle $\alpha$ which the thread forms together with the axis "a" of the drum, and accordingly engages said thread only at the output circumference C1.

What is claimed is:

1. A device for exerting a braking force on thread being drawn off a thread feeder unit wherein the feeder unit includes a drum having a maximum circumference on which a plurality of turns of thread are wound around the drum axis to form a thread reserve, the drum has an output circumference at one end which is smaller in circumference than the maximum circumference, and the thread is drawn axially off the drum over the output circumference, said braking device comprising:

(a) a braking body which is symmetric in shape around an axis and has a thread passage through said body;

(b) said body including a metal band which is very thin relative to its width and has active braking surface facing inwardly toward said axis, said surface being sufficiently hard to be resistant to wear from thread friction;

(c) said surface being substantially continuous around said axis; and (d) an elastic element connected to said band and adapted to resiliently urge said active braking surface into engagement with the output circumference of the drum for braking a thread which passes between said surface and said output circumference.

2. The braking device of claim 1 further characterized in that:

a) said substantially continuous active braking surface is shaped substantially like a truncated cone, with a larger diameter end and a smaller diameter end, said smaller diameter end of said cone adapted to extend axially away from the drum.

3. The braking device of claim 2 further characterized in that:

a) said body comprises a metal plate having a thickness of between 0.05 and 0.10 millimeters.

4. The braking device of claim 2 further characterized in that:

a) said substantially truncated-cone shape of said active braking surface has straight generatrices.

5. The braking devices of claim 2 further characterized in that:

a) said elastic element has an annular shape and surrounds said body (substantially truncated-cone braking body has marked radial elasticity).

6. In a braking device for exerting a braking force on a thread being drawn off the output circumference of a thread feeder unit, a thread brake comprising:

(a) an annular braking body which is symmetric in shape around an axis around a thread passage through which thread is adapted to be withdrawn; and (b) a substantially continuous active braking surface extending entirely around said body and facing inwardly toward said passage; and (c) said braking surface being formed on a metal band which is very thin relative to its width and is sufficiently hard to be resistant to wear from thread friction; and (d) said body being radially elastic; and (e) means for urging said braking surface against a thread which passes between said surface and the output circumference.

7. The thread brake of claim 6 further characterized in that:

a) said band is substantially frusto-conical in shape.

8. A system including a thread braking device and a weft feeder unit of the type comprising at least one drum on which a plurality of turns of a thread constituting a thread reserve are wound, said drum having an axis and a maximum circumference, said thread braking device comprising:

a) a braking member (means) which has a continuous circular band;

b) said band having the shape of a truncated cone tapering axially away from said drum and contacting said drum intermediate the band edges along a line on an output circumference smaller than said maximum circumference with a continuous contacting surface of steel or other wear resistant material, said band displaying very small inertia, (marked) radial elasticity and substantial axial rigidity;

c) said braking member (means) being supported by an elastic element (means) coaxially with respect to said drum;

d) said braking member (means) being actuated by said elastic element (means) to elastically effect said contacting;

e) said thread, as unwound from said drum, running between said drum and said braking member (means) at said line and extending from said line to a thread guide (means) disposed substantially at the axis of said drum along a path which is inclined by a pre-set angle with respect to the axis of the drum.

9. A system according to claim 8, in which:

a) said band extends between 5 and 15 millimeters on both sides of said line.

10. A system according to claim 8, in which:

a) said band has a taper which is 2–3% smaller than said pre-set angle.

11. A system according to claim 8, in which:

a) said band consists of a steel plate of a thickness of between four and ten hundredths of a millimeter.

12. A system including a thread braking device and a weft feeder unit of the type comprising at least one drum on which a plurality of turns of a thread constituting a thread reserve are wound, said drum having an axis and a maximum circumference, said braking device comprising:

a) braking means which has a continuously extending circular thread contacting surface consisting of a thin, wear resistant metallic layer on a truncated-cone body of synthetic material;

b) said braking means being supported by elastic means coaxially with respect to said drum;

c) said braking means being actuated by said elastic means to elastically engage against said drum along an output circumference of said drum which is smaller than said maximum circumference and to exert an elastic force thereon;

d) said thread, as unwound from said drum, running between said drum and said braking means and extending from said output circumference to a thread guide means disposed substantially at the axis of said drum along a path which is inclined by a preset angle with respect to the axis of said drum.

13. A braking for exerting a braking force on a thread being drawn off the output circumference of a thread feeder unit, comprising:

(a) a thin, radially flexible metal band extending substantially continuosly around an axis;

(b) said band having substantially the shape of a truncated cone around said axis;

(c) said band having a thread passage through it coaxial with said axis and a substantially continuous internal thread contacting surface extending substantially continuously around said axis in said passage; and (d) means for urging said braking surface against a thread which passes between said surface and the output circumference.

14. The braking device of claim 13 further characterized in that:

a) the width of said band along said axis is between 10 millimeters and 30 millimeters.

15. A system including a thread braking device and a weft feeder unit of the type comprising a drum on which a plurality of turns of a thread constituting a thread reserve are wound around an axis, said drum having a maximum circumference and an output circumference smaller than said maximum circumference over which said thread is drawn axially off said drum, said thread braking device comprising:

(a) a braking body including a continuous circular band;

(b) said band having substantially the shape of a truncated cone tapering inwardly from one annular edge to another annular edge as it extends axially away from said drum;

(c) said band contacting the drum intermediate the band edges on said output circumference with a contacting surface of wear resistant material;

(d) said braking body being supported by elastic means coaxially with respect to said drum;

(e) said band being elastically urged into engagement with said output circumference of said drum;

(f) said thread, as it is unwound from said drum, running between said output circumference of said drum and said band and extending from said band to a thread guide which is coaxial with said axis.

16. A weft feeder unit and thread braking device combination, comprising:

(a) a drum on which a plurality of turns of thread constituting a thread reserve are wound, said drum having a maximum circumference section and a smaller circumference output section over which the thread travels when it is withdrawn axially from said drum;

(b) a thread brake band shaped substantially like a truncated cone with a thread passage therethrough coaxial with the band and the drum;

(c) said band being formed of material hard enough to be substantially resistent to wear from thread friction; and (d) an elastic element connected to said band and urging it elastically into engagement with said output circumference section for applying a braking action against a thread which passes between said band and said smaller circumference

17. A device for exerting a braking force on thread being drawn off a thread feeder unit wherein the feeder unit includes a drum on which a plurality of turns of thread are wound around the drum axis to form a thread reserve, the drum having a maximum circumference and an output circumference at one end which is smaller in circumference than the maximum circumference, the thread being drawn axially off the drum over the output circumference, said braking device comprising:

(a) an annular braking body which is symmetric around a thread passage and has a larger diameter end and a smaller diameter end;

(b) said body including a substantially continuous active braking surface extending around said passage adjacent said diameter end; and (c) means for mounting the braking device on a feeder unit with said braking surface urged resiliently against the output circumference of the drum, said means including an annular elastic element connected to said smaller end and extending radially outwardly therefrom.

18. The braking device of claim 17 further characterized in that:

(a) said body includes an annular band of wear resistant material on which said active braking surface is formed.

19. The braking device of claim 18 further characterized in that:

(a) said band is formed of metal.

20. The braking device of claim 18 further characterized in that:

(a) said band is shaped substantially like a truncated cone.

21. The braking device of claim 19 further characterized in that:

(a) said band is shaped substantially like a truncated cone.

* * * * *